US009021759B2

(12) United States Patent
Lehane, Jr. et al.

(10) Patent No.: US 9,021,759 B2
(45) Date of Patent: May 5, 2015

(54) SERPENTINE INSERT FOR OPEN WEB GRID

(75) Inventors: James J. Lehane, Jr., McHenry, IL (US); Peder J. Gulbrandsen, Aurora, IL (US)

(73) Assignee: USG Interiors, LLC, Chicago, IL (US)

( * ) Notice: Subject to any disclaimer, the term of this patent is extended or adjusted under 35 U.S.C. 154(b) by 121 days.

(21) Appl. No.: 13/495,017

(22) Filed: Jun. 13, 2012

(65) Prior Publication Data

US 2013/0333317 A1 Dec. 19, 2013

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04B 9/06*** | (2006.01) |
| *E04C 3/04* | (2006.01) |

(52) U.S. Cl.

CPC ..... *E04B 9/067* (2013.01); *E04C 2003/046* (2013.01)

(58) Field of Classification Search

CPC ..... E04B 9/00; E04B 9/06; E04B 9/064; E04B 9/065; E04B 9/067; E04B 9/068; E04B 9/10; E04B 9/16; E04B 9/18; E04B 9/22; E04B 9/225; E04B 9/24; E04B 9/241; E04B 9/26; E04B 9/28; E04B 9/30; E04C 3/02; E04C 3/04; E04C 3/08; E04C 2003/0404; E04C 2003/0408; E04C 2003/0413; E04C 2003/0443; E04C 2003/0452; E04C 2003/046

USPC ..... 52/506.01, 506.06–506.09, 636, 831, 52/836, 837, 846, 856

See application file for complete search history.

(56) References Cited

U.S. PATENT DOCUMENTS

| | | | | | |
|---|---|---|---|---|---|
| 184,522 | A | * | 11/1876 | Hammond | 52/693 |
| 573,151 | A | | 12/1896 | Johnson | |
| 1,006,047 | A | | 10/1911 | Bates | |
| 1,741,423 | A | * | 12/1929 | Lachman | 52/636 |
| 2,029,645 | A | * | 2/1936 | Waugh | 52/377 |
| 2,052,024 | A | | 8/1936 | Hahn | |
| 2,055,756 | A | | 9/1936 | Sutton | |
| 2,108,373 | A | * | 2/1938 | Greulich | 52/842 |
| 2,141,642 | A | | 12/1938 | Cross | |
| 2,142,637 | A | | 1/1939 | Faber | |
| 2,252,956 | A | | 8/1941 | Adler | |
| 2,689,630 | A | * | 9/1954 | Drury | 52/506.07 |

(Continued)

FOREIGN PATENT DOCUMENTS

| | | |
|---|---|---|
| FR | 796027 | 5/1959 |
| GB | 504 405 A | 4/1939 |

(Continued)

OTHER PUBLICATIONS

Notification of Transmittal of the International Search Report and the Written Opinion of the International Searching Authority, or the Declaration for PCT/US2013/044459, filed Jun. 6, 2013, International Search Report dated Sep. 6, 2013, Written Opinion of the International Searching Authority.

*Primary Examiner* — Joshua J Michener
*Assistant Examiner* — Theodore Adamos
(74) *Attorney, Agent, or Firm* — Pearne & Gordon LLP

(57) ABSTRACT

A grid runner and method of its manufacture that saves material content with use of a serpentine sheet metal web configured to be essentially scrapless and that results in a parallel chord truss-like construction with open spaces between an upper reinforcing bulb and a lower flange.

4 Claims, 2 Drawing Sheets

(56) References Cited

U.S. PATENT DOCUMENTS

| | | | | | |
|---|---|---|---|---|---|
| 3,214,875 | A | | 11/1965 | Dawdy | |
| 3,256,670 | A | | 6/1966 | Ennio | |
| 3,263,387 | A | * | 8/1966 | Simpson | 52/634 |
| 3,286,427 | A | * | 11/1966 | Cotter | 52/506.07 |
| 3,354,598 | A | * | 11/1967 | Nicholson | 52/506.07 |
| 3,381,439 | A | | 5/1968 | Thulin, Jr. | |
| 3,517,474 | A | * | 6/1970 | Lanternier | 52/842 |
| 3,789,563 | A | | 2/1974 | Toti | |
| 3,800,490 | A | | 4/1974 | Conte | |
| 3,840,960 | A | | 10/1974 | Toti | |
| 3,979,874 | A | * | 9/1976 | Cubbler et al. | 52/664 |
| 4,206,578 | A | | 6/1980 | Mieyal | |
| 4,207,719 | A | * | 6/1980 | Knowles | 52/693 |
| 4,292,782 | A | * | 10/1981 | Schaeffer | 52/696 |
| 4,442,650 | A | | 4/1984 | Sivachenko | |
| 4,489,529 | A | | 12/1984 | Ollinger et al. | |
| 4,494,350 | A | | 1/1985 | Sharp | |
| 4,525,972 | A | | 7/1985 | Palacio et al. | |
| 4,548,014 | A | * | 10/1985 | Knowles | 52/693 |
| 4,702,059 | A | * | 10/1987 | Holtz | 52/650.1 |
| 4,713,919 | A | | 12/1987 | Platt | |
| 4,765,111 | A | | 8/1988 | Osawa | |
| 5,207,045 | A | * | 5/1993 | Bodnar | 52/600 |
| 5,524,410 | A | * | 6/1996 | Menchetti | 52/838 |
| 5,664,388 | A | | 9/1997 | Chapman | |
| 5,669,197 | A | | 9/1997 | Bodnar | |
| 5,809,724 | A | | 9/1998 | Bodnar | |
| 5,842,318 | A | | 12/1998 | Bass et al. | |
| 5,867,962 | A | * | 2/1999 | Scott et al. | 52/696 |
| 5,979,055 | A | | 11/1999 | Sauer et al. | |
| 6,047,511 | A | | 4/2000 | Lehane | |
| 6,115,986 | A | | 9/2000 | Kelly | |
| 6,122,888 | A | | 9/2000 | Bodnar | |
| 6,131,362 | A | | 10/2000 | Buecker | |
| 6,170,217 | B1 | * | 1/2001 | Meyer | 52/693 |
| 6,418,694 | B1 | | 7/2002 | Daudet et al. | |
| 6,526,716 | B2 | | 3/2003 | Paul | |
| 6,796,093 | B2 | | 9/2004 | Brandes | |
| 6,912,787 | B1 | | 7/2005 | Ruble et al. | |
| 7,140,158 | B2 | * | 11/2006 | Steadman | 52/694 |
| 7,231,746 | B2 | | 6/2007 | Bodnar | |
| 7,516,585 | B2 | | 4/2009 | Lehane et al. | |
| 7,587,877 | B2 | | 9/2009 | Strickland et al. | |
| 7,669,374 | B2 | * | 3/2010 | Miller et al. | 52/506.07 |
| 7,669,379 | B2 | * | 3/2010 | Schierding | 52/634 |
| D618,826 | S | | 6/2010 | Lehane, Jr. | |
| 7,765,762 | B2 | | 8/2010 | Gulbrandsen et al. | |
| 7,784,243 | B2 | * | 8/2010 | Zahner, III | 52/846 |
| 7,832,168 | B2 | | 11/2010 | Lehane et al. | |
| 7,877,961 | B2 | * | 2/2011 | Strickland et al. | 52/837 |
| 7,908,813 | B2 | | 3/2011 | Gulbrandsen et al. | |
| 8,033,076 | B2 | | 10/2011 | Plagemann et al. | |
| 2005/0034398 | A1 | * | 2/2005 | Mauk et al. | 52/506.01 |
| 2005/0144892 | A1 | * | 7/2005 | Strickland et al. | 52/729.1 |
| 2005/0210819 | A1 | * | 9/2005 | McGushion | 52/729.1 |
| 2007/0028554 | A1 | | 2/2007 | Ferrell et al. | |
| 2007/0044425 | A1 | * | 3/2007 | Ubilla | 52/733.2 |
| 2007/0113507 | A1 | | 5/2007 | Lehane | |
| 2007/0272342 | A1 | * | 11/2007 | Holmes | 156/73.5 |
| 2007/0277466 | A1 | | 12/2007 | Platt | |
| 2008/0148668 | A1 | | 6/2008 | Jahn | |
| 2008/0155915 | A1 | * | 7/2008 | Howe et al. | 52/220.3 |
| 2008/0155935 | A1 | * | 7/2008 | Raheel et al. | 52/733.1 |
| 2008/0289280 | A1 | * | 11/2008 | LaLonde | 52/506.07 |
| 2009/0320395 | A1 | * | 12/2009 | Strickland et al. | 52/289 |
| 2010/0126089 | A1 | * | 5/2010 | Fransson | 52/220.1 |
| 2010/0257807 | A1 | | 10/2010 | Raheel et al. | |
| 2011/0247296 | A1 | | 10/2011 | Stal et al. | |
| 2012/0304574 | A1 | * | 12/2012 | Gulbrandsen et al. | 52/506.07 |

FOREIGN PATENT DOCUMENTS

| | | | |
|---|---|---|---|
| GB | 937440 | | 9/1963 |
| WO | 97/06321 | A1 | 2/1997 |
| WO | 2004/109030 | A1 | 12/2004 |

* cited by examiner

SERPENTINE INSERT FOR OPEN WEB GRID

BACKGROUND OF THE INVENTION

The invention relates to suspended ceiling grid construction.

PRIOR ART

Suspended ceilings typically include a rectangular metal grid on which are supported ceiling tiles or drywall panels. The commercial construction industry is highly competitive and, accordingly, the cost of building materials in this sector is important. Raw material consumption, particularly material without a large recycled content, is likewise a concern for preservation of the environment. Accordingly, there is a need for suspended grid products that consume less material and can be economically produced.

SUMMARY OF THE INVENTION

The invention is embodied in a suspended ceiling grid runner having a material saving open web construction. The inventive grid runner is an elongated assembly of main parts comprising a lower face flange, an upper reinforcing bulb and an open web extending vertically between the flange and bulb. The web has a novel serpentine configuration extending alternately from the flange to the bulb and from the bulb to the flange. The web is fixed to the flange and bulb at each juncture. By virtue of its serpentine configuration, the web is characterized by open spaces along the length of the runner that represent significant material savings. In the preferred runner construction, the flange and bulb are roll formed sheet metal strips while the web is a flat, stamped strip. These components are assembled together in a press that clinches the parts together at locally overlapping points.

The web strip is sheared from sheet stock, preferably supplied from a coil. The shear has specially shaped cutting edges corresponding to the serpentine form of the web. By way of example and not limitation, the web sheet stock is fed to a shear in ¾ in. increments while producing a web 1⅜ in. high without scrap. The inventive runner is advantageously assembled in a press operation that also performs the traditional cross tee slot and hanger hole punching.

DESCRIPTION OF THE PREFERRED EMBODIMENT

Figure 1:
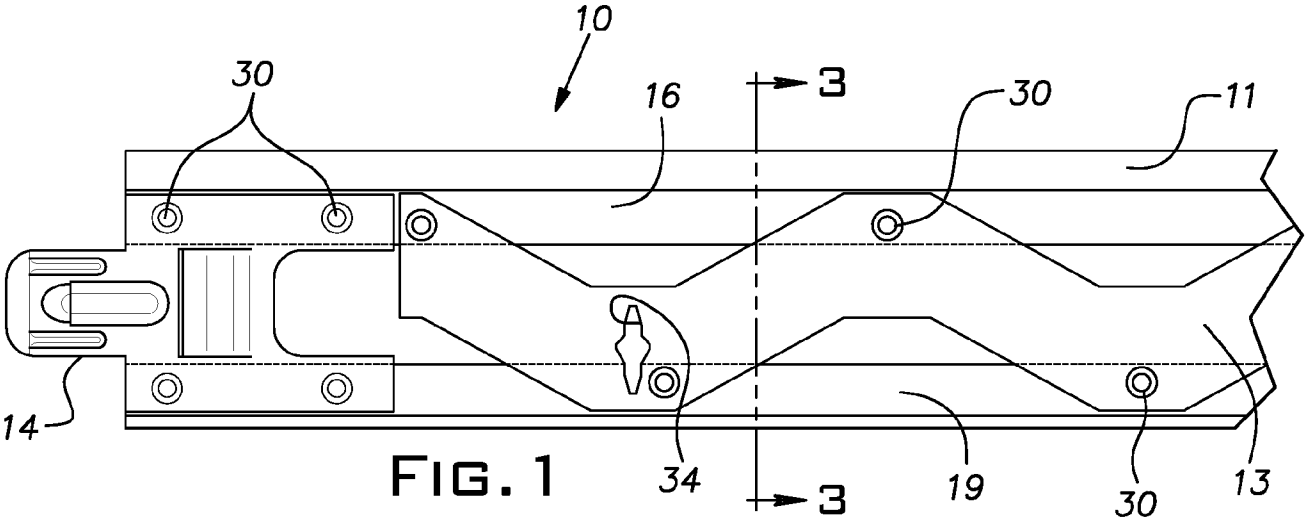
FIG. 1 is a fragmentary side elevational view of a grid runner constructed in accordance with the invention.
Figure 2:
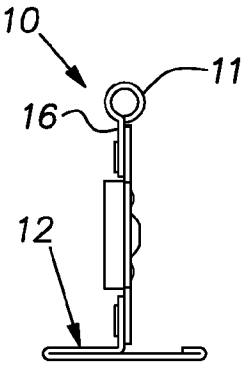
FIG. 2 is an end view of the grid runner of FIG. 1.
Figure 3:
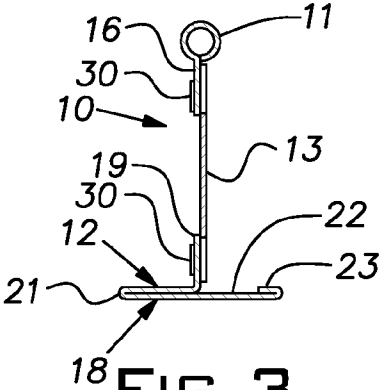
FIG. 3 is a cross sectional view of the grid runner taken in the plane 3-3 indicated in FIG. 1.

A grid runner 10, illustrated in FIGS. 1-3, is used in a conventional manner to construct a rectangular grid for a suspended ceiling. The illustrated grid runner 10 has the shape of an inverted tee in the orientation it is used. The grid runner 10, which typically can have a height in the order of 1 9/16 in. can be provided as a main runner and have a nominal length of 12 ft. The runner 10 is an assembly of three main elongated parts comprising an upper hollow reinforcing bulb 11, a lower face flange 12, and a vertical web 13 extending between the bulb 11 and flange 12. Identical end connectors 14 are provided on each end of the runner 10 (only one end is shown in FIG. 1). The connectors 14 may, for example, be of the type illustrated in U.S. Pat. No. 6,729,100.

Preferably, the bulb 11 and flange 12 are each made by roll forming a single sheet metal strip, usually steel, with conventional techniques well known in the industry. The flange 12 can be pre-painted prior to roll forming on a side visible when installed. The bulb is hollow with a circular cross section. The bulb 11 can be formed with various other cross sectional shapes such as an oval, rectangle, triangle or other polygon. The bulb 11 is preferably formed with the hollow space essentially closed. The bulb 11 includes a depending rib 16 that lies in a vertical plane bisecting the hollow part, the latter comprising the bulb proper.

The illustrated flange 12 has the shape of an inverted short tee. In use, the flange commonly becomes the visible face of the grid runner 10 where the grid runner is used with ceiling tiles. A horizontal part 18 of the flange 12 extends widthwise, i.e. transversely to the longitudinal direction of the runner and symmetrically about a vertical upstanding stem or rib 19. One side 21 of the horizontal flange part 18 is a double wall or two ply construction while an opposite side 22 is a single wall with a folded back hem 23 at an edge distal from the rib 19. In ordinary use of the runner 10 in a suspended ceiling, edges of rectangular ceiling panels or tiles rest on upper surfaces of the flange horizontal part 18.

Figure 4:
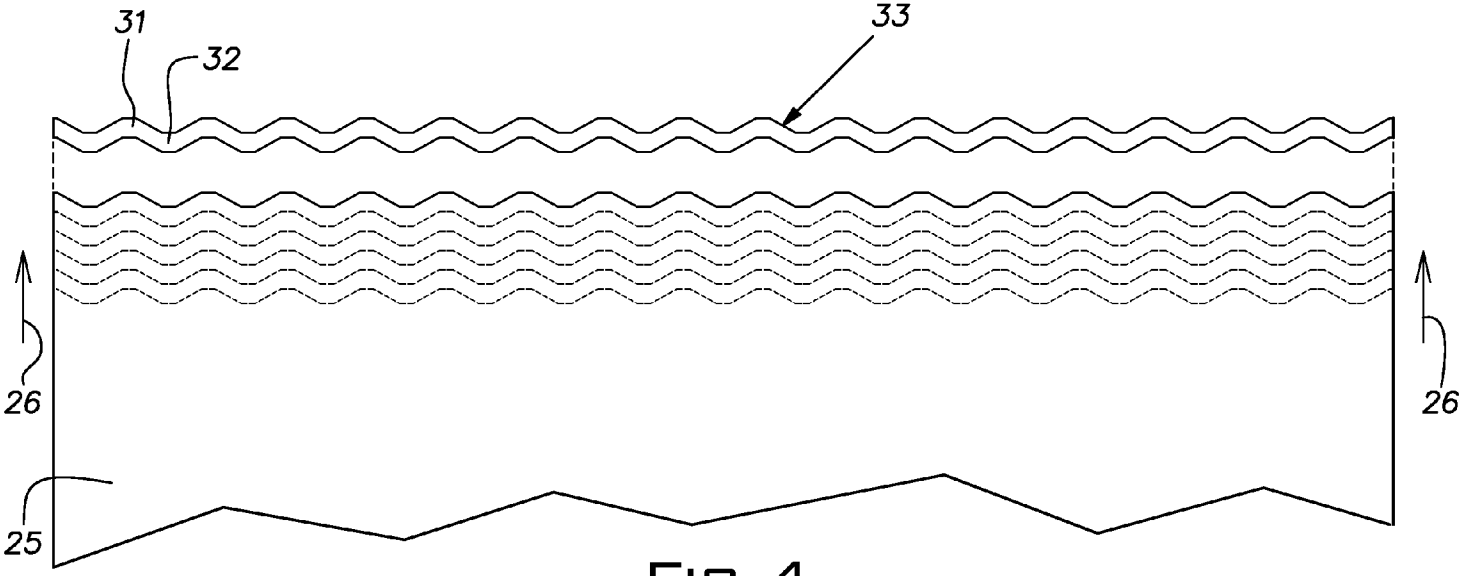
FIG. 4 is a diagrammatic representation of a shearing process used to make a serpentine web of the inventive grid runner.

The web 13 is a flat sheet metal stamping that serves to hold the bulb 11 and flange 12 in spaced relation in the manner of a parallel chord truss. Referring to FIG. 4, the web 13 is formed by shearing a strip from a sheet of steel or other metal 25, typically from coil stock. The web strip is sheared along a serpentine line symmetrical with a line that is perpendicular to the feed direction of the sheet stock indicated by the arrows 26 from the supply coil. Alternatively, the serpentine strip or web can be sheared from a flat non-coiled sheet stock although this will involve greater scrap due to cuts at the end of the sheet stock. The serpentine cut profile of the web 13 is cut such that its top and bottom edges have the same geometry. This results from the sheared edge remaining on the stock supply becoming one of the edges of the next sheared web piece.

In profile, the web 13 can be described as having crests 31 and valleys 32 that, in the illustrated case, are flat at their respective top and bottom edges. The serpentine pattern of the web 13 allows the web to span, from the outside edges of the valleys 32 to the outside edges of the crests 31 a distance of 1⅜ in., for example, while the stock need only be fed ¾ in., for example, to produce this span. When assembled, the web crest flats and valley flats can abut the bottom of the bulb 11 and top of the single ply flange side 22, respectively.

Figure 5:
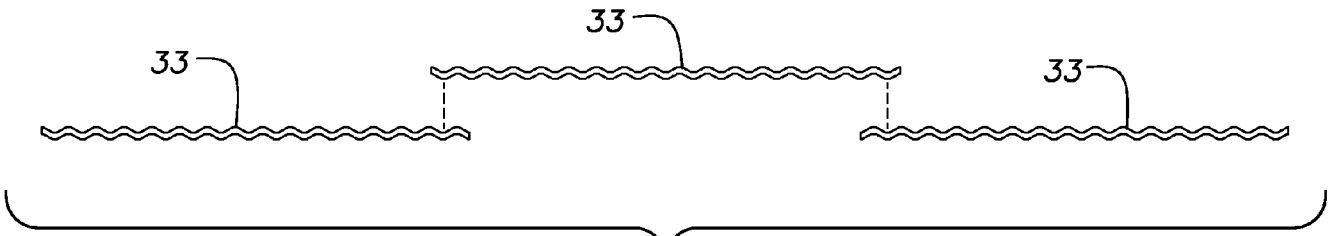
FIG. 5 is a diagrammatic representation of the assembly of three web inserts used in the construction of the main runner embodying the invention.

The grid runner 10 is assembled in a press of a length adequate to span the length of the grid runner. The disclosed grid runner construction is ideally suited for main runners which are nominally 12 ft. long or industry metric equivalent. When the runner 10 is this long, it is practical to use 2 or 3 web sections 33 arranged end to end. Making the full length web 13 from the sub-parts or sections 33 enables the use of light gauge coil stock of a conventional width. Preferably, the web sections 33 are slightly overlapped at their adjacent ends when assembled into a grid runner 10. FIG. 5 illustrates three web sections 33 with their adjacent ends aligned to be overlapped and joined in a single main runner 10.

Figure 6:
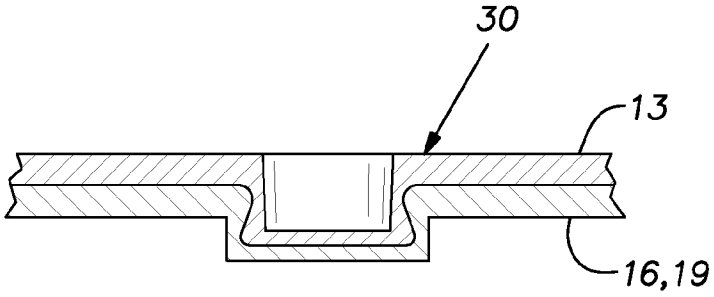
FIG. 6 is a cross sectional view of a typical clinch joint between the web and the bulb or the flange of the grid runner.

With reference to FIG. 1, the web 13 is fixed to the bulb 11 and flange 12 in a press. The web crests 31 are fixed to the bulb rib 16 and the valleys 32 are fixed to the flange rib 19. FIG. 6 illustrates a typical permanent clinch joint 30 made by a known technique such as that marketed under the trademark TOX® (a registered trademark of Pressotechnik GmbH & Co. KG). The technique involves lapping these members and driving a part of the web into respective parts of the bulb and flange ribs 16, 19. The same clinch location can be used to join the overlapped ends of the web sections 33 to a bulb rib or a flange rib. Cross tee slots 34 are preferably punched from the side of the runners from which the web 13 is assembled to simplify this punching operation. Hanger holes, not shown, can be punched in the bulb rib 16 and any overlying portion of the web 13 during the press operation. The end connectors 14 are metal plates assembled on the ends of the bulb 11 and flange 12, preferably with the clinch shown in FIG. 6. The end connectors 14 can be of the general type shown, for example, in U.S. Pat. No. 6,729,100.

It is envisioned that a material savings up to about 30% can be obtained with the serpentine web 13 as compared to constructions having a conventional web with no large open areas. While the foregoing disclosure involves a main runner or main tee, the serpentine open web construction can be used to construct cross runners. The flange can have different cross sectional configurations other than the illustrated simple tee. Such configurations can include a downwardly open channel, sometimes referred to as a screw slot runner.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A grid runner for a suspended ceiling comprising an elongated hollow metal reinforcing bulb having a central depending rib, an elongated metal flange having a central upstanding rib, and an elongated sheet metal web having a continuous serpentine profile characterized by a plurality of crests and a plurality of valleys, each crest being situated between two valleys, the crests being fixed to the bulb rib and abutting the bulb, the valleys being fixed to the flange rib and abutting the flange, the web maintaining the bulb and flange ribs vertically spaced from one another and providing open areas between the bulb and flange ribs in areas below the crests and/or above the valleys, the sheet metal web being formed of one or more elongated sections made from coil stock of conventional width, the web being formed with slots for receiving cross tees, the web being sheared from sheet metal stock such that an upper edge of the sheared web has a profile that is the same as a bottom edge of the web, whereby the bottom edge is a geometric complement of and is of the same length as the upper edge.

2. The grid runner as set forth in claim 1, the web being constructed of at least two elongated sections joined by overlapping adjacent ends lying in planes parallel to a plane of the web.

3. A grid runner as set forth in claim 1, wherein the web is fixed to the bulb and flange with integral clinches.

4. A grid runner for a suspended ceiling comprising an elongated hollow metal reinforcing bulb having a central depending rib, an elongated metal flange having a central upstanding rib, and an elongated sheet metal web having a continuous serpentine profile characterized by upper and lower sheared edges that are geometrical complements with the same profile and of the same length and that form a plurality of crests and a plurality of valleys, each crest being situated between two valleys, the crests being fixed to the bulb rib and the valleys being fixed to the flange rib, the web maintaining the bulb and flange ribs vertically spaced from one another and providing open areas between the bulb and flange ribs in areas below the crests and/or above the valleys, the web being constructed of at least two elongated sections joined by overlapping adjacent ends lying in planes parallel to a plane of the web.

* * * * *